US005704688A

United States Patent [19]

Schrewe et al.

[11] Patent Number: 5,704,688

[45] Date of Patent: Jan. 6, 1998

[54] CHAIR

[75] Inventors: Klaus Schrewe, Brilon; Holger Siedler, Arolsen-Mengeringshausen, both of Germany

[73] Assignee: Mauser Office GmbH, Korbach, Germany

[21] Appl. No.: 627,183

[22] Filed: Apr. 3, 1996

[51] Int. Cl.[6] ..... A47C 7/44

[52] U.S. Cl. ..... 297/285; 297/301.1; 297/301.5

[58] Field of Search ..... 297/285, 296, 297/297, 299, 301.1, 301.5, 301.8, 354.1, 354.11

[56] References Cited

U.S. PATENT DOCUMENTS

| | | | |
|---|---|---|---|
| 3,139,307 | 6/1964 | Hawley et al. | 297/452.65 |
| 4,733,910 | 3/1988 | Brennan | 297/385 X |
| 4,856,846 | 8/1989 | Lohmeyer | 297/285 X |
| 4,913,493 | 4/1990 | Heidmann | 297/285 |

FOREIGN PATENT DOCUMENTS

| | | | |
|---|---|---|---|
| 0 166 828 | 1/1986 | European Pat. Off. . | |
| 0552388 | 7/1993 | European Pat. Off. . | |
| 2264834 | 3/1975 | Germany | 297/452.65 |
| 23 60 165 | 6/1975 | Germany . | |
| 2360165 | 6/1975 | Germany . | |
| 78 18 311 | 6/1978 | Germany . | |
| 81 17 703 | 6/1981 | Germany . | |
| 35 22 845 | 1/1985 | Germany . | |
| 31 15 269 | 6/1985 | Germany . | |
| 35 21 908 | 1/1986 | Germany . | |
| 36 04 534 | 8/1987 | Germany . | |
| 3604534 | 8/1987 | Germany . | |
| 36 25 824 | 2/1988 | Germany . | |
| 39 04 090 | 8/1990 | Germany . | |
| 92 14 219 | 12/1992 | Germany . | |
| 0585 753 | 3/1993 | Germany . | |
| 0 552 388 | 7/1993 | Germany . | |
| 44 03 071 | 8/1994 | Germany . | |
| 44 03 073 | 8/1994 | Germany . | |
| 44 27 754 | 2/1996 | Germany . | |
| 647 665 | 11/1979 | Switzerland . | |
| 647665 | 2/1985 | Switzerland . | |

*Primary Examiner*—Peter R. Brown

*Attorney, Agent, or Firm*—Herbert Dubno; Andrew Wilford

[57] ABSTRACT

A chair has a base, a generally horizontal seat supported on the base, and a generally vertical back supported on the base behind the seat and provided at a predetermined spacing above the seat with a horizontally extending flex joint having formations for permitting free pivoting backward of an upper portion of the back to a predetermined backwardly deflected position and for thereafter resisting further backward deflection. The back comprises a front plate, a cushion carried on the front plate, and a rear plate fixed to the front plate and formed with the flex joint. The formations include a pair of extending flanges extending generally horizontally from the rear plate and a bight interconnecting the two flanges. The flex joint can be unitarily formed with the rear plate. Its flanges are vertically spaced from each other and only touch when the predetermined backwardly deflected position is reached.

9 Claims, 9 Drawing Sheets

CHAIR

FIELD OF THE INVENTION

The present invention relates to a chair. More particularly this invention concerns a pivotal or so-called steno chair.

BACKGROUND OF THE INVENTION

A standard pivotal steno chair of the type used by an office worker has a normally wheeled base supporting a generally horizontal seat cushion. An upright back cushion is mounted behind the seat cushion to provide support for the user's lower back.

One problem with such chairs is providing proper back support, since the user normally spends a great deal of time in the chair. Normally this is accomplished by mounting the entire chair back on a support that allows it to be deflected backward against a spring force. The end position can be limited on some models as can the spring force. It is even possible to adjust the curvature of the front face of some models to adjust the lumbar support.

OBJECTS OF THE INVENTION

It is an object of the present invention to provide an improved chair.

Another object is the provision of such an improved chair which overcomes the above-given disadvantages, that is which is particularly comfortable and which even offers a new way of adapting to the user.

SUMMARY OF THE INVENTION

A chair has a base, a generally horizontal seat supported on the base, and a generally vertical back supported on the base behind the seat and provided at a predetermined spacing above the seat with a horizontally extending flex joint having formations for permitting free pivoting backward of an upper portion of the back to a predetermined backwardly deflected position and for thereafter resisting further backward deflection.

The seat back according to the invention is particularly simple and inexpensive to manufacture yet provides excellent back support. As the user leans back the part of the seat back engaging the upper back will deflect backward until the lower part of the seat back comes into solid contact with the lumbar region, providing anatomically correct back support. According to the invention the vertical position of the flex joint about an upper surface of the seat is adjusted for the user in question, up for a tall person, down for a short one. Normally the back has a forwardly curved front face with a region of furthest forward projection and the flex joint is offset from this region.

More specifically according to the invention the back comprises a front plate, a cushion carried on the front plate, and a rear plate fixed to the front plate and formed with the flex joint. The formations include a pair of flanges extending generally horizontally from the rear plate and a bight interconnecting the two flanges. The flex joint can be unitarily formed with the rear plate. Its flanges are vertically spaced from each other and only touch when the predetermined backwardly deflected position is reached.

Alternately the formation includes a flex strip between the flanges. The rear plate and flex strip are forwardly curved and the flex strip is formed with horizontally extending grooves. The flex strip has a flange projecting forward and engaging the bight. The rear plate is formed of a stiff plastic and the flanges and bight end short of vertical side edges of the back and the rear plate is formed outward of the formations with vertically extending tabs. To maximize flexibility the front plate also is formed generally level with the flex joint with a horizontally extending flex region of greater flexibility than the front plate above and below the flex region. This flex region is formed by meander strips.

According to another feature of the invention a chair of the above-described general type, that is having a base, a generally horizontal seat supported on the base, and a generally vertical back supported on the base behind the seat, is provided with a lumbar support. This support has according to the invention an inflatable bladder inside the back, and a pump inside the back and actuatable by pressure on the back for inflating the bladder. The front plate carries the bladder and pump, a cushion is carried on the front plate, and a rear plate is fixed to the front plate. A valve is provided in the back having an actuating member operable for venting the bladder and the pump is mounted on a front face of the front plate behind the cushion.

More particularly according to the invention the front plate is formed with a cutout holding the pump. The pump includes a bulb partially recessed in the front plate and the valve is mounted on a back face of the front plate. The front plate is forwardly curved at the bladder.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
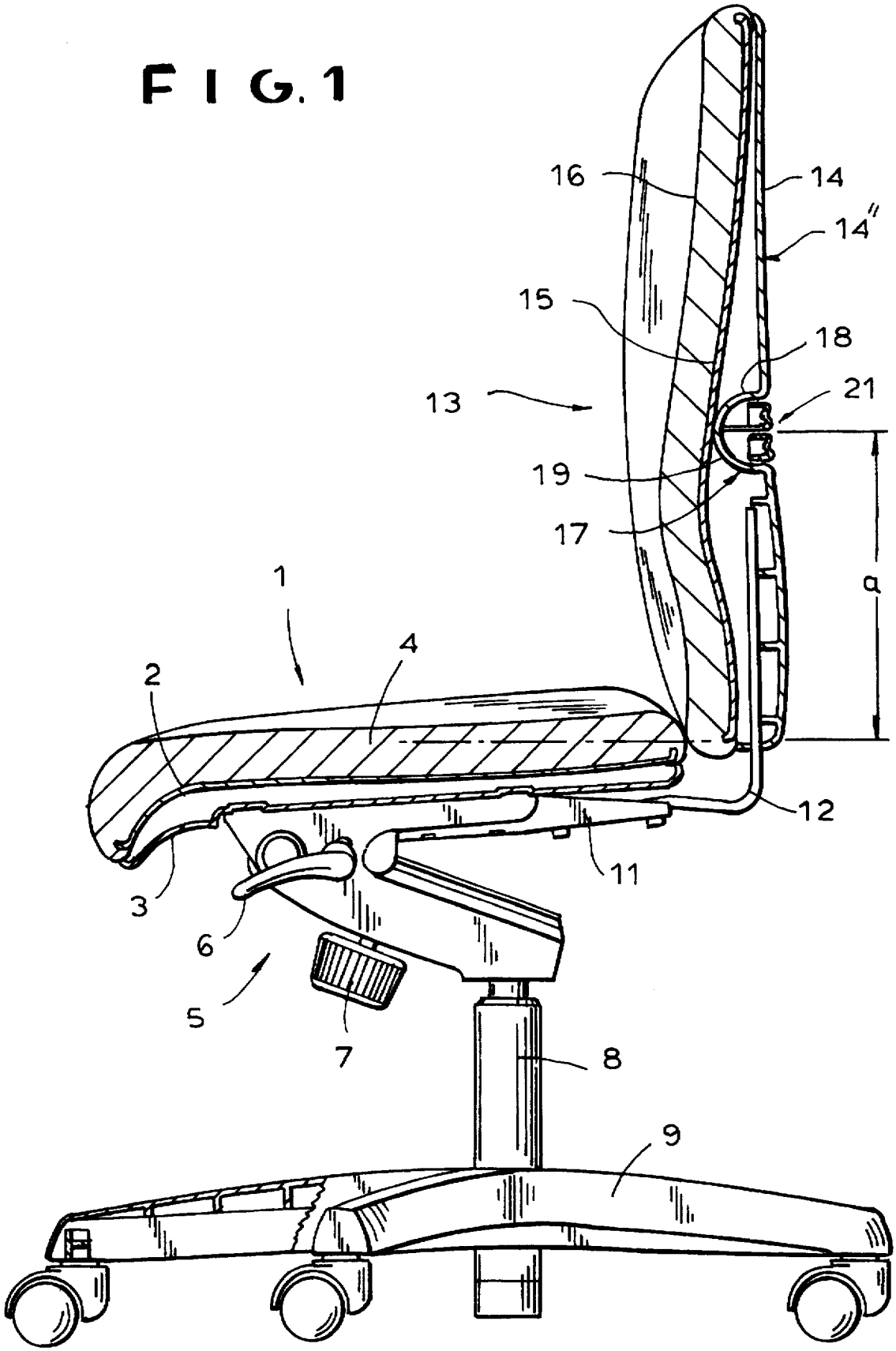
FIG. 1 is a vertical section through a chair according to the instant invention.
Figure 2:
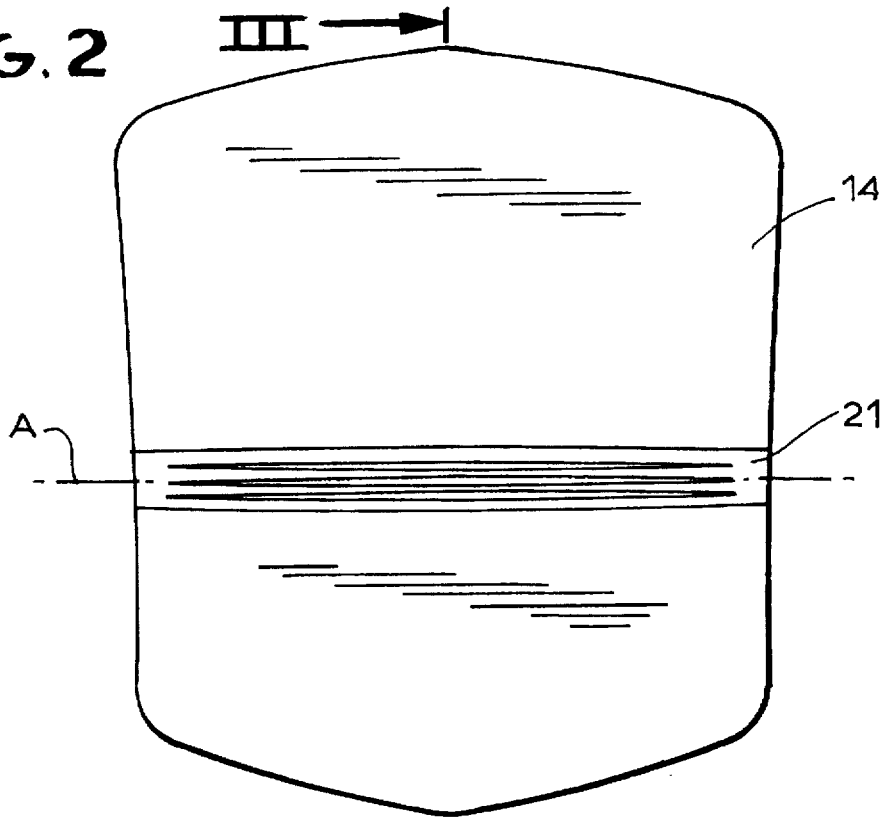
FIG. 2 is a rear view of the chair back.

As seen in FIG. 1 a steno chair according to the invention has a generally horizontal seat 1 formed by a fairly rigid support plate 3 carrying a cushion 4 and supported on a base 5 having adjustment elements 6 and 7 for setting the height and angle of the seat 1. The base 5 has a stem 8 seated in a wheel star 9 for supporting the chair on the floor. A rearwardly projecting frame member 11 carries an L-shaped bracket 12 on whose vertical arm is mounted a vertical chair back 13 comprised of a rear plate 14, a front plate 15, and a cushion 16 adhered to the front plate 15.

Figure 6:
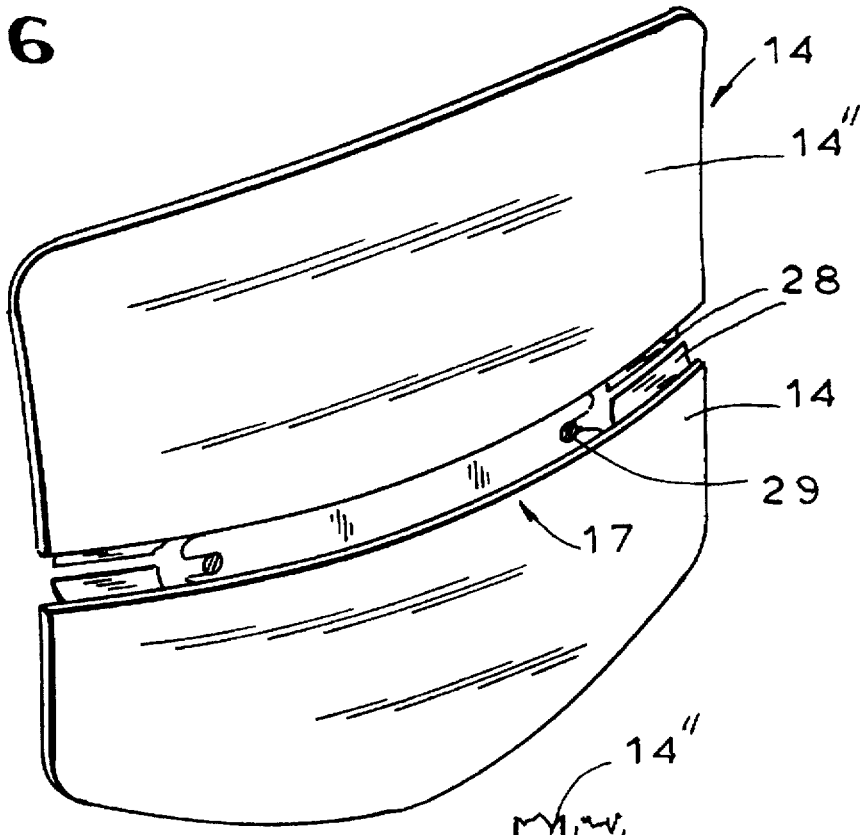
FIG. 6 is a perspective view of the rear plate of the chair back without the flex-strip insert.
Figure 7:
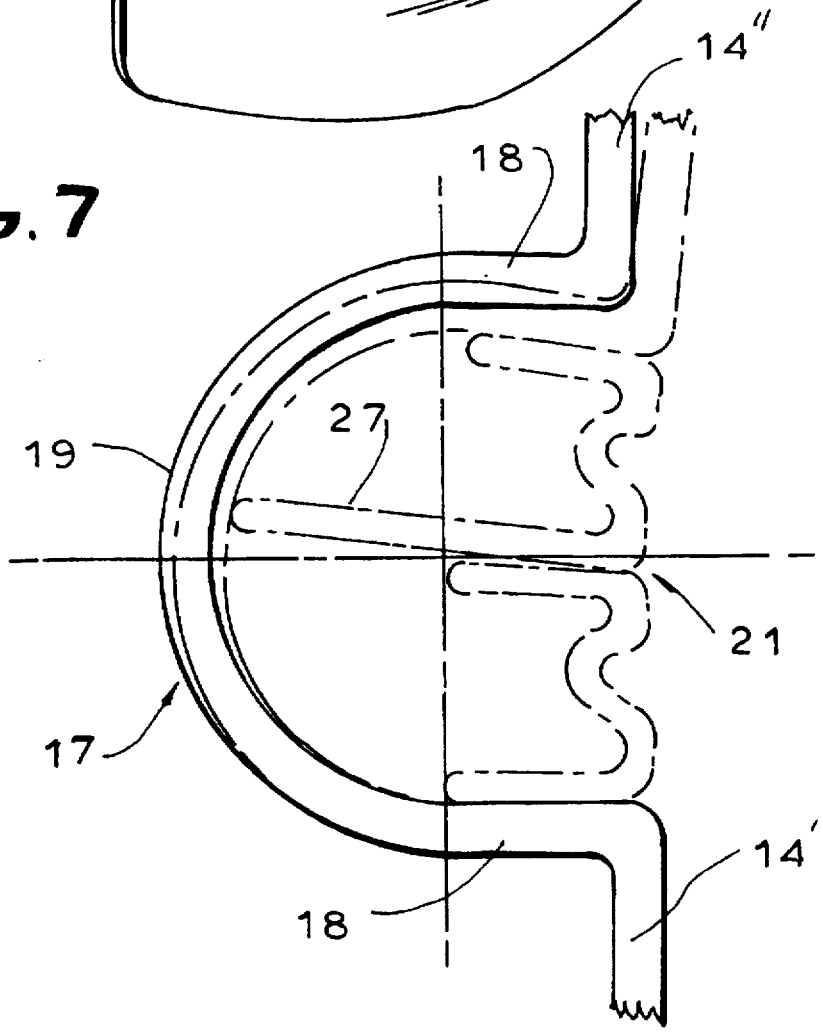
FIG. 7 is a large-scale view of a detail of FIG. 5.
Figure 8:
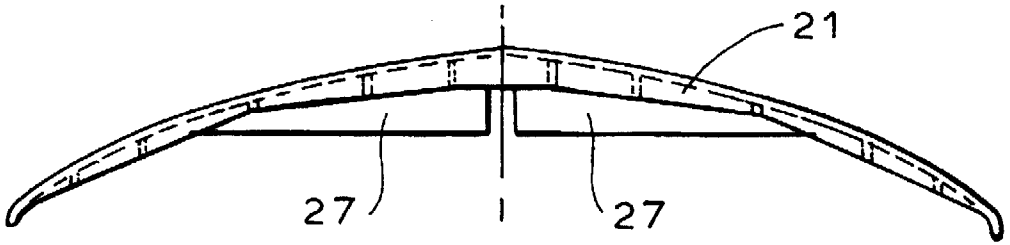
FIG. 8 is a top view of the flex strip of the chair back.
Figure 9:
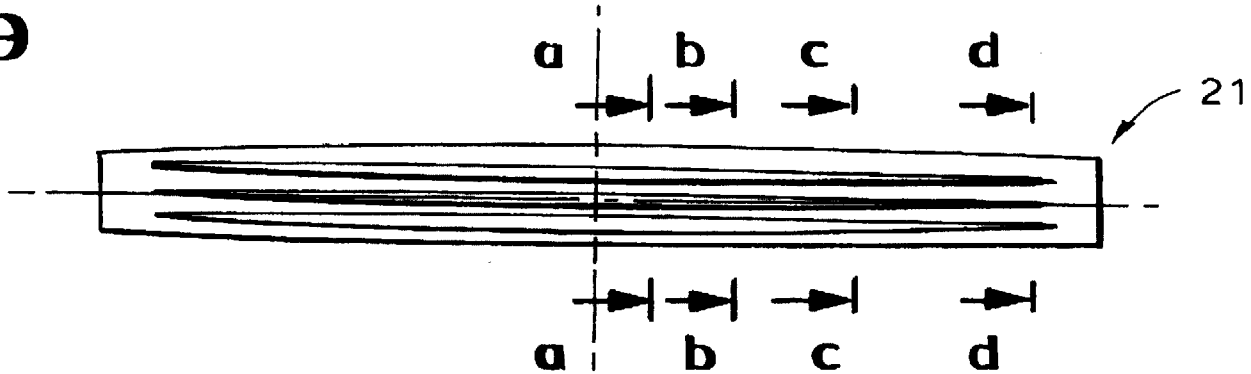
FIG. 9 is a rear view of the flex strip of FIG. 8.
Figures 10A, 10B, 10C, 10D:
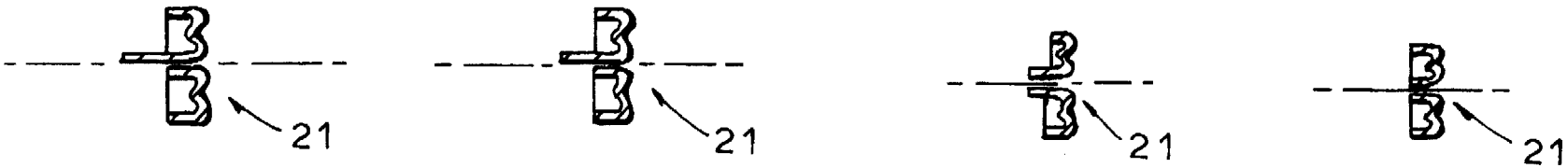
FIGS. 10*a*, 10*b*, 10*c*, and 10*d* are sections taken along respective lines Xa—Xa, Xb—Xb, Xc—Xc, and Xd—Xd of FIG. 9.

As better seen in FIGS. 2 through 5 the rear plate 14 is provided with a central horizontally extending flex joint 17 dividing it into a lower panel 14' and an upper panel 14" that can flex relative to each other about a horizontal axis A. This joint 17 is a U-section formation having a pair of legs 18 extending generally perpendicular to the rear plate 14 and a circularly arcuate bight 19 connecting them, these parts all being unitarily formed of the same sheet material from which the rear plate 14 is molded. As shown in FIGS. 6 and 7 the joint 17 ends short of the vertical side edges of the rear plate 14 which is formed outward of the ends of the legs 18 and bight 19 with inwardly projecting tabs 28. The bight 19 is formed at its end with notches 29 for receiving screws that hold in place a flex strip 21 made of polyoxymethylene of two parts 24 and 25 normally separated by a horizontally extending gap 23. The strip parts 24 and 25 are formed with longitudinally extending grooves 26 and the upper part 24 has an elongated lower flange 27 that extends forward to the bight 19 to ensure proper positioning of the flex strip 21.

Figure 5:
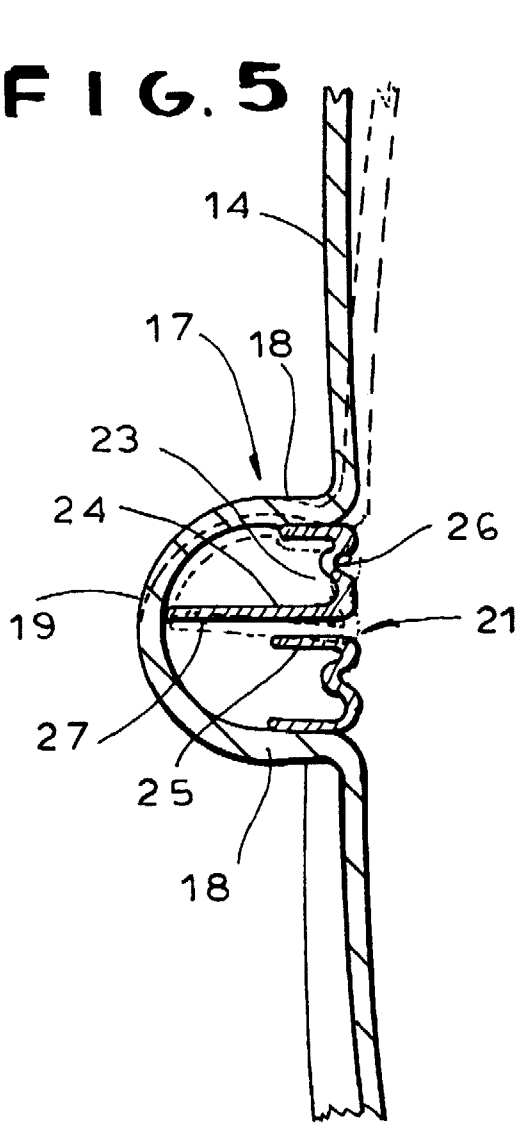
FIG. 5 is a large-scale view of a detail of FIG. 4.
Figure 4:
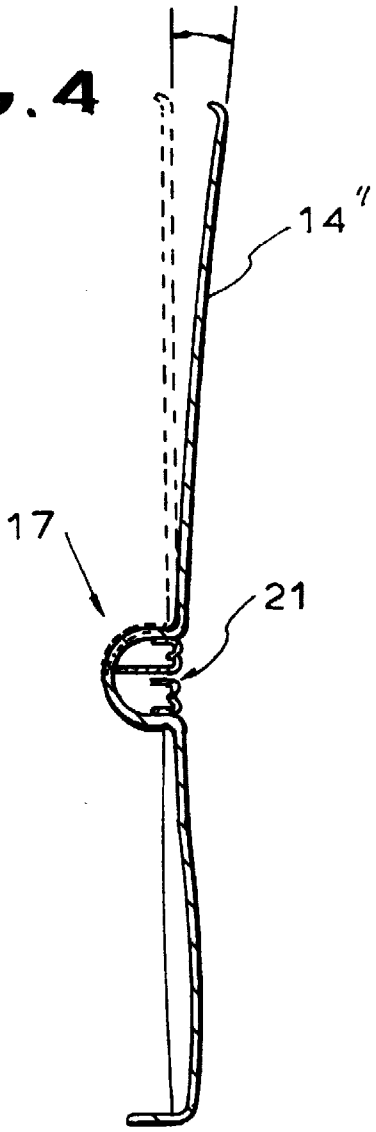
FIGS. 3 and 4 are vertical sections taken along line III—III of FIG. 2 through the rear plate in normal and deflected positions, respectively.
Figure 3:
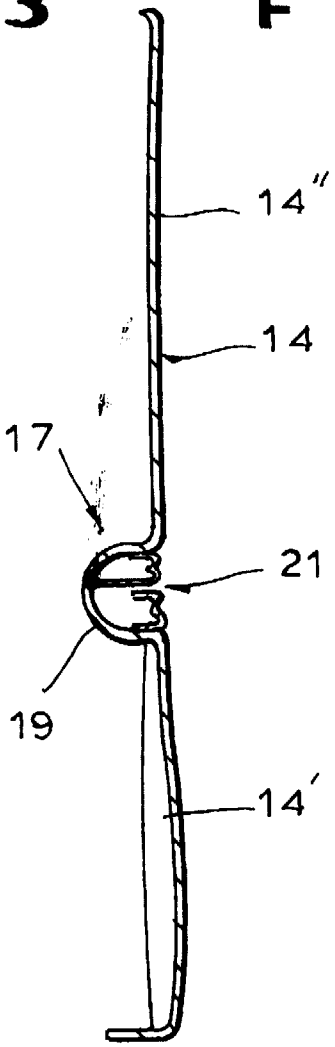

With this arrangement when the top half 14" of the plate 14 is bent back through an angle 22, the gap 23 is closed as indicated at dashed lines in FIGS. 5 and 7. Thus the top region of the chair back 13 can be bent back fairly easily to a certain point, when the gap 23 closes, whereupon it will resist further backward deflection with considerably more force.

Figure 11:
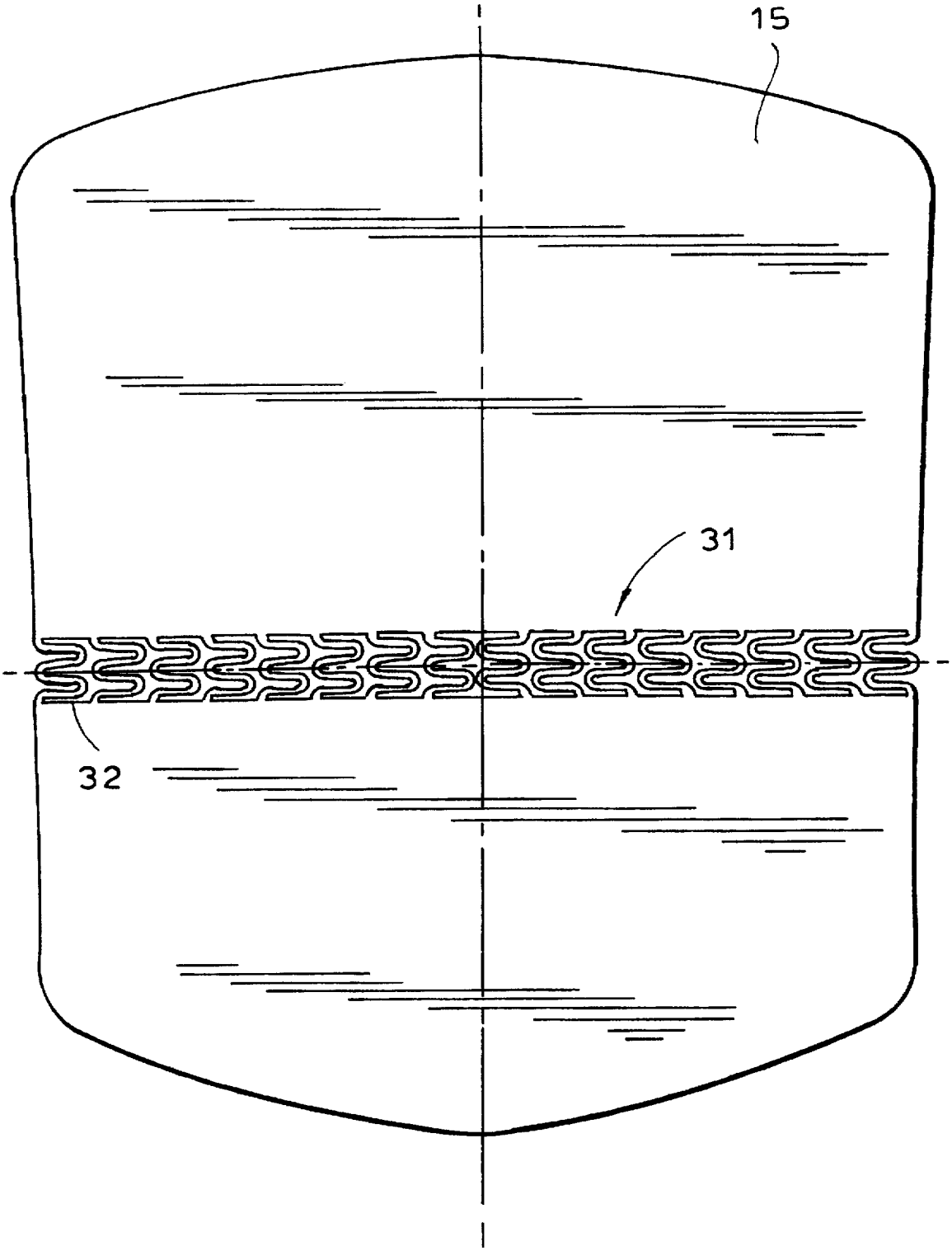
FIG. 11 is a front view of the front plate of the chair back.

The front plate 14 of the seat back 13 as shown in FIG. 11 has a central flex region 31 formed with a plurality of meander-shaped connecting webs 32 level with the strip 21 so that this plate 15 can bend in this region easily.

Figure 12:
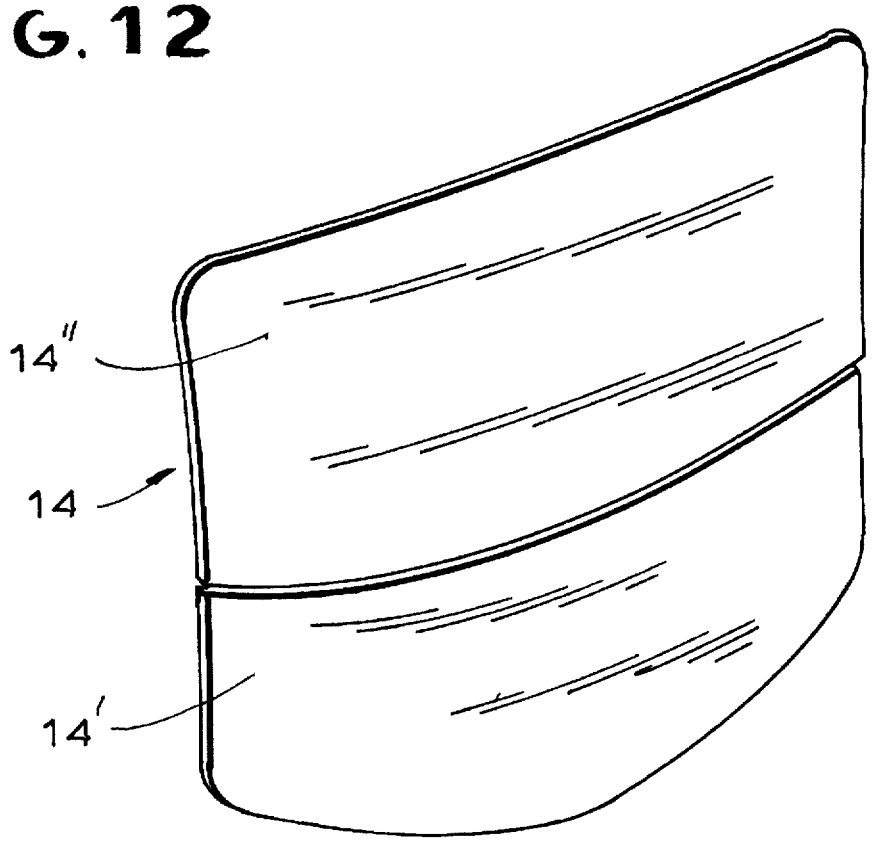
FIG. 12 is a perspective view of another variant of the back.
Figure 13:
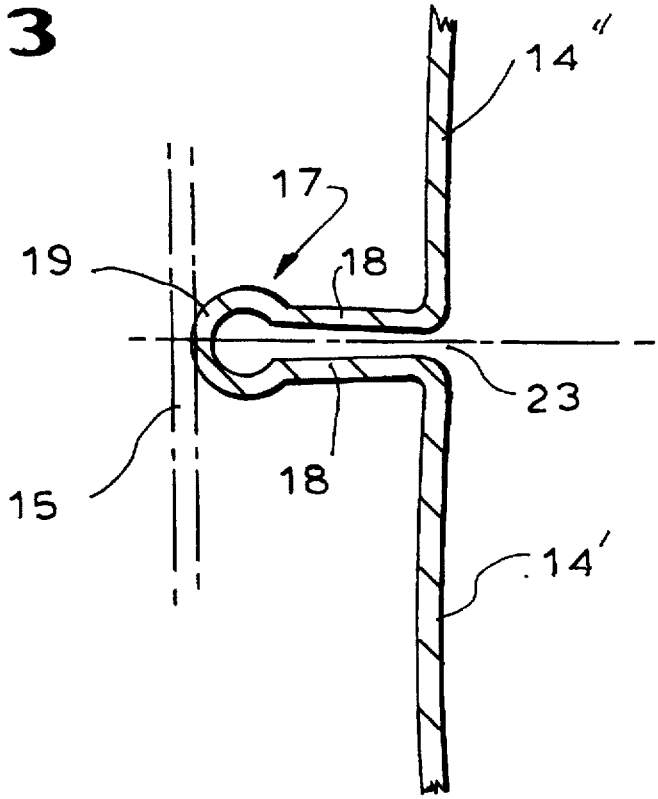
FIG. 13 is a vertical section through a detail of FIG. 14.

FIGS. 12 and 13 show an alternate arrangement where the plate 14 is not provided with the strip 21 but instead the gap 23 is formed directly by the two legs 18 of the flex joint 17. As in the embodiment of FIGS. 1–11, when the gap 23 is closed by backward deflection of the upper panel 14", the resistance to further backward deflection is greatly increased.

Figure 16:
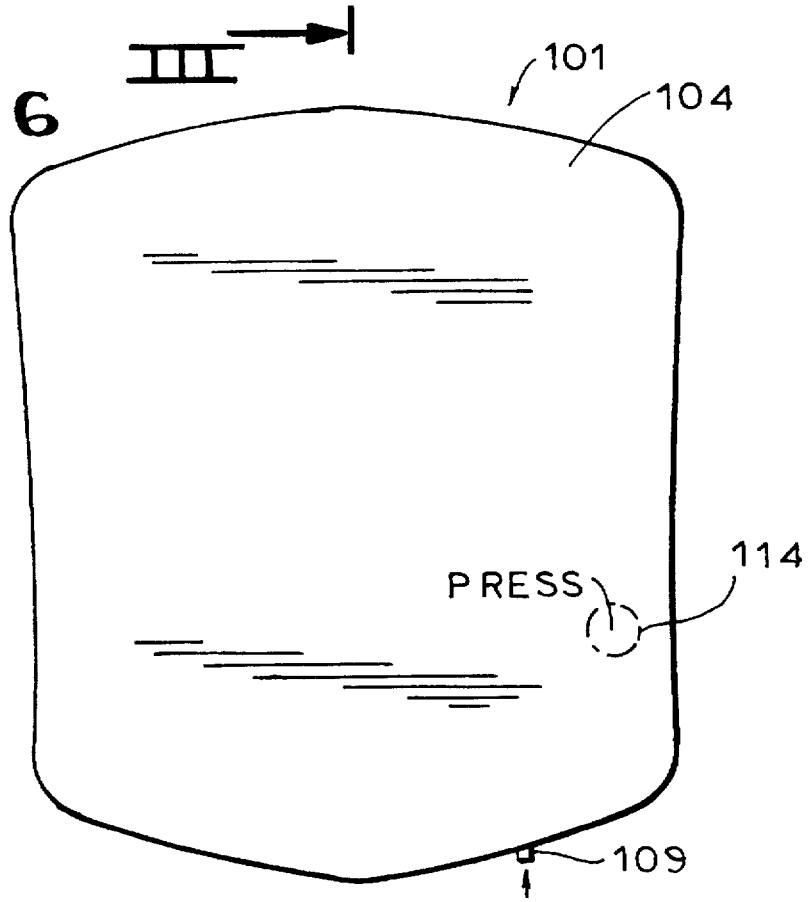
FIG. 16 is a front view of the chair back of FIG. 14.
Figure 14:
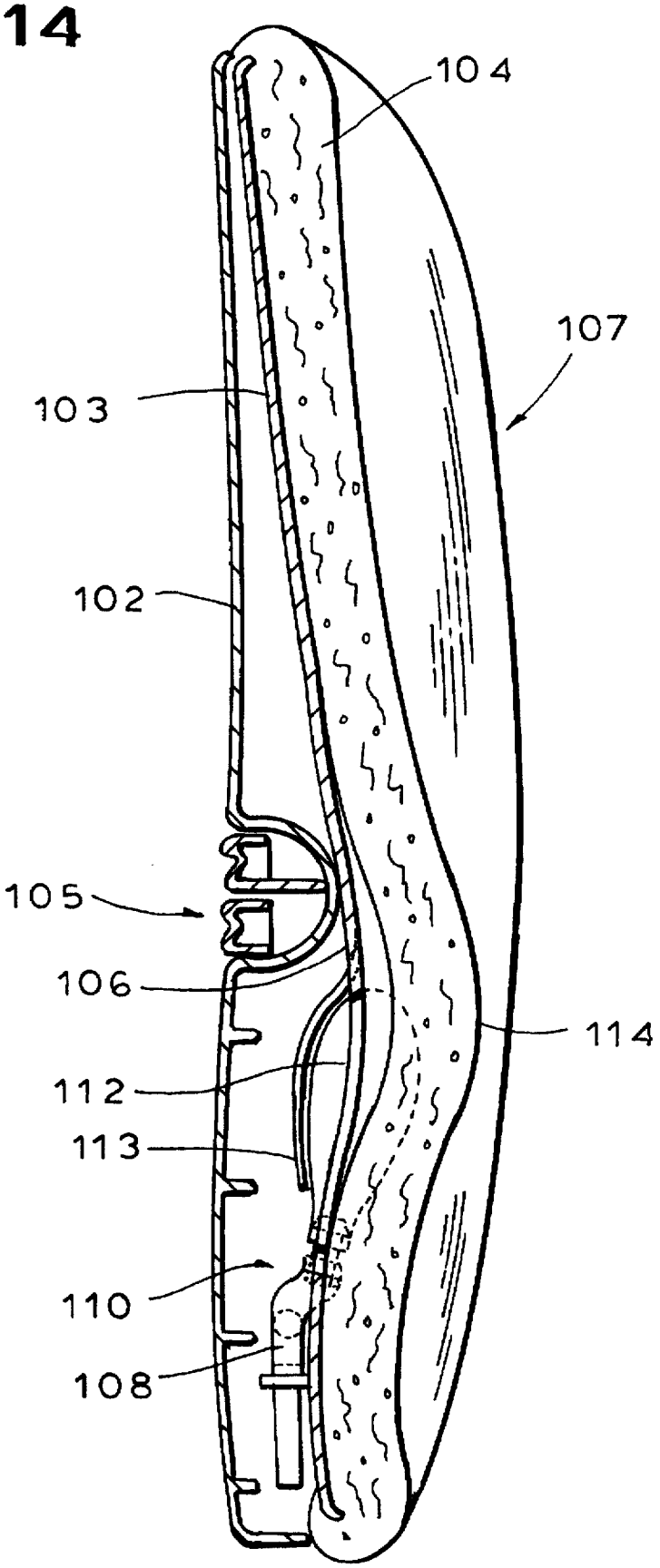
FIG. 14 is a vertical section through another chair back according to the invention.
Figure 15:
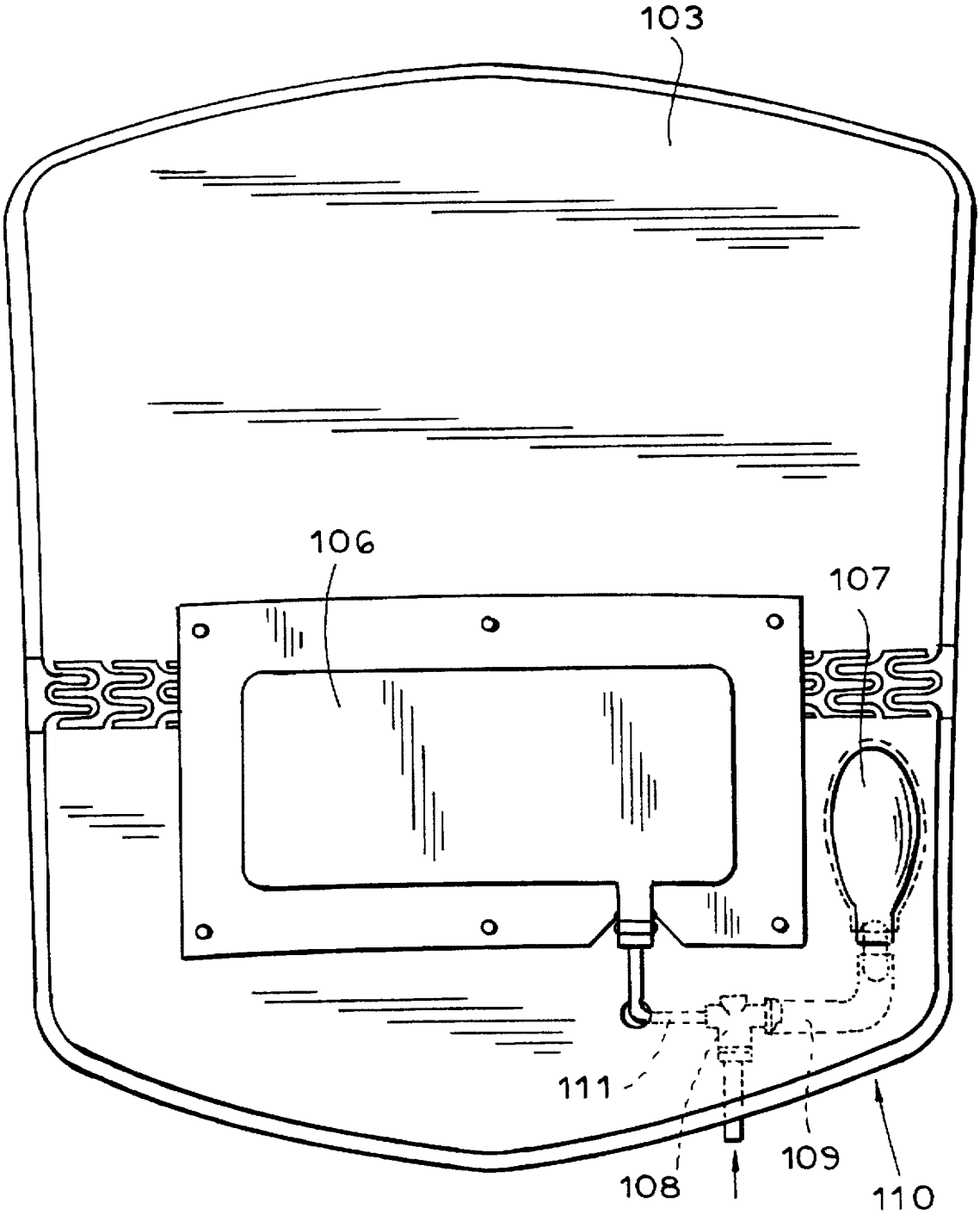
FIG. 15 is a front view of the front plate of the chair back of FIG. 14.

In the system of FIGS. 14 through 16 a seat back 101 has a rear plate 102, a front plate 103, and a cushion 104. A flex joint 105 is provided on the rear plate 102 and a bladder 106 is provided on a front face of the front plate 103 in the region where it would engage the lumbar region of a person sitting on a chair having the back 101. This bladder 106 can be pressurized by a bulb-type pump 107 connected via piping 109 and a valve 108 to a tube 111 itself connected to the bladder 106 and forming a pump unit 110. The front plate 103 is formed with a hole 112 through which the bulb is accessible and has a flap 113 against which it engages. The cushion 104 is provided with a marking 114 that is pressed to compress the bulb 107 and inflate the bladder 106. The valve 108 has an actuating button 109 accessible along a bottom edge of the chair back 101 so that the bladder 106 can be depressurized.

Thus the user of this chair can pump up the bladder 106 by means of the pump 107 until the desired lumbar support is obtained. If the bladder 106 is overinflated, actuation of the button 109 vents it so that it can be pressurized to the desired level.

We claim:

1. A chair having a base;

a generally horizontal seat supported on the base; and a generally vertical back supported on the base behind the seat and having a front plate, a cushion carried on the front plate, and a rear plate fixed to the front plate and formed with the flex joint, a horizontally extending flex joint at a predetermined spacing above the seat and having means including a pair of flanges extending generally horizontally from the rear plate, a bight interconnecting the two flanges for permitting free pivoting backward of an upper portion of the back to a predetermined backwardly deflected position and for thereafter resisting further backward deflection, and an elastically compressible flex strip between the flanges, the rear plate and flex strip being concavely curved forward toward the front plate and the flex strip being formed with horizontally extending grooves.

2. The improved chair defined in claim 1, wherein the back has a forwardly curved front face with a region of furthest forward projection, the flex joint being offset vertically from the region.

3. The improved chair defined in claim 1, wherein the flanges are vertically spaced from each other and only touch when the predetermined backwardly deflected position is reached.

4. The improved chair defined in claim 1, wherein the formation includes a flex strip between the flanges.

5. The improved chair defined in claim 1 wherein the flex strip has a flange projecting forward and engaging the bight.

6. The improved chair defined in claim 1 wherein the rear plate is formed of a stiff plastic.

7. The improved chair defined in claim 1 wherein the flanges and bight end short of vertical side edges of the back.

8. A chair having a base;

a generally horizontal seat supported on the base; and a generally vertical back supported on the base behind the seat and having a front plate, a cushion carried on the front plate, and a rear plate fixed to the front plate and formed with the flex joint a horizontally extending flex joint at a predetermined spacing above the seat and having means including a pair of flanges extending generally horizontally from the rear plate and a bight interconnecting the two flanges for permitting free pivoting backward of an upper portion of the back to a predetermined backwardly deflected position and for thereafter resisting further backward deflection, the front plate being formed in a region generally level with the flex joint with a horizontally extending flex region of greater flexibility than regions of the front plate above and below the flex region.

9. The improved chair defined in claim 8 wherein the flex region is formed by flexible meander strips.

* * * * *